US007794283B2

(12) United States Patent
Wang

(10) Patent No.: US 7,794,283 B2
(45) Date of Patent: Sep. 14, 2010

(54) SOCKET, PLUG, AND ADAPTOR COMBINATION WITH WATERPROOF ARRANGEMENT

(75) Inventor: Sheng Lien Wang, Jhudhong Township, Hsinchu County (TW)

(73) Assignee: Ting Shen Industrial Co., Ltd, Hsinchu (TW)

( * ) Notice: Subject to any disclaimer, the term of this patent is extended or adjusted under 35 U.S.C. 154(b) by 0 days.

(21) Appl. No.: 12/320,806

(22) Filed: Feb. 5, 2009

(65) Prior Publication Data

US 2010/0197157 A1 Aug. 5, 2010

(51) Int. Cl.
*H01R 31/00* (2006.01)
*H01R 33/00* (2006.01)

(52) U.S. Cl. ..... 439/651

(58) Field of Classification Search ..... 439/638, 439/651, 587

See application file for complete search history.

(56) References Cited

U.S. PATENT DOCUMENTS 4,274,698 A * 6/1981 Ahroni ..... 439/620.3
6,190,207 B1 * 2/2001 Wang ..... 439/620.31
6,454,604 B1 * 9/2002 Currie et al. ..... 439/606
7,140,920 B1 * 11/2006 Lin ..... 439/620.3
2004/0137796 A1 * 7/2004 Sivertsen ..... 439/638
2007/0224881 A1 * 9/2007 Fujiwara et al. ..... 439/587

* cited by examiner

*Primary Examiner*—Felix O Figueroa
(74) *Attorney, Agent, or Firm*—Bacon & Thomas, PLLC

(57) ABSTRACT

A socket, plug, and adaptor combination includes a housing having a forward sliding door; an inverted L-shaped circuit assembly in the housing having a conductor mounting section in the vertical part; a transformer being concealed in the horizontal part of the circuit assembly in a waterproof way and adapted to electrically connect to a power cord; two electrical connection assemblies each disposed in the conductor mounting section and having a prong; a conductive assembly comprising two separate fuses disposed in the conductor mounting section, each fuse being electrically interconnected between the prong and the transformer; a cover releasably secured onto the circuit assembly and having two sockets distal the prongs; and a covering plate disposed between the transformer and the cover. The combination is applicable to be used as a charger for outdoor LED type Christmas light strings.

3 Claims, 8 Drawing Sheets

SOCKET, PLUG, AND ADAPTOR COMBINATION WITH WATERPROOF ARRANGEMENT

BACKGROUND OF THE INVENTION

1. Field of Invention

The invention relates to electrical plugs and more particularly to such a waterproof plug and adaptor combination having a pair of electrical sockets for electrically connecting to prongs of another plugs and a waterproof transformer in which the plug and adaptor combination can be used as a charger.

2. Description of Related Art

Conventionally, an electrical plug is used to connect to, for example, a wall outlet for supplying AC power to an electrical device. Further, multifunctional plugs are commercially available. Such plug typically has a pair of sockets or other features.

U.S. Pat. No. 7,140,920 discloses an electric plug having two rear prong-receiving grooves so that the prongs of another plug may be electrically connected thereto by inserting into the grooves. The electric plug % has a voltage-limiting component.

Both U.S. application Ser. Nos. 12/081,017 and 12/244,361 are my previous endeavors. It is understood that waterproof feature is essential to plugs for outdoor applications. Further, outgrowth of a patent is always desired by inventors. Thus, the invention is directed to an improvement of the above applications.

SUMMARY OF THE INVENTION

It is therefore one object of the invention to provide a novel socket, plug, and adaptor combination with a waterproof transformer.

The above and other objects, features and advantages of the invention will become apparent from the following detailed description taken with the accompanying drawings.

DETAILED DESCRIPTION OF THE INVENTION

Figure 1:
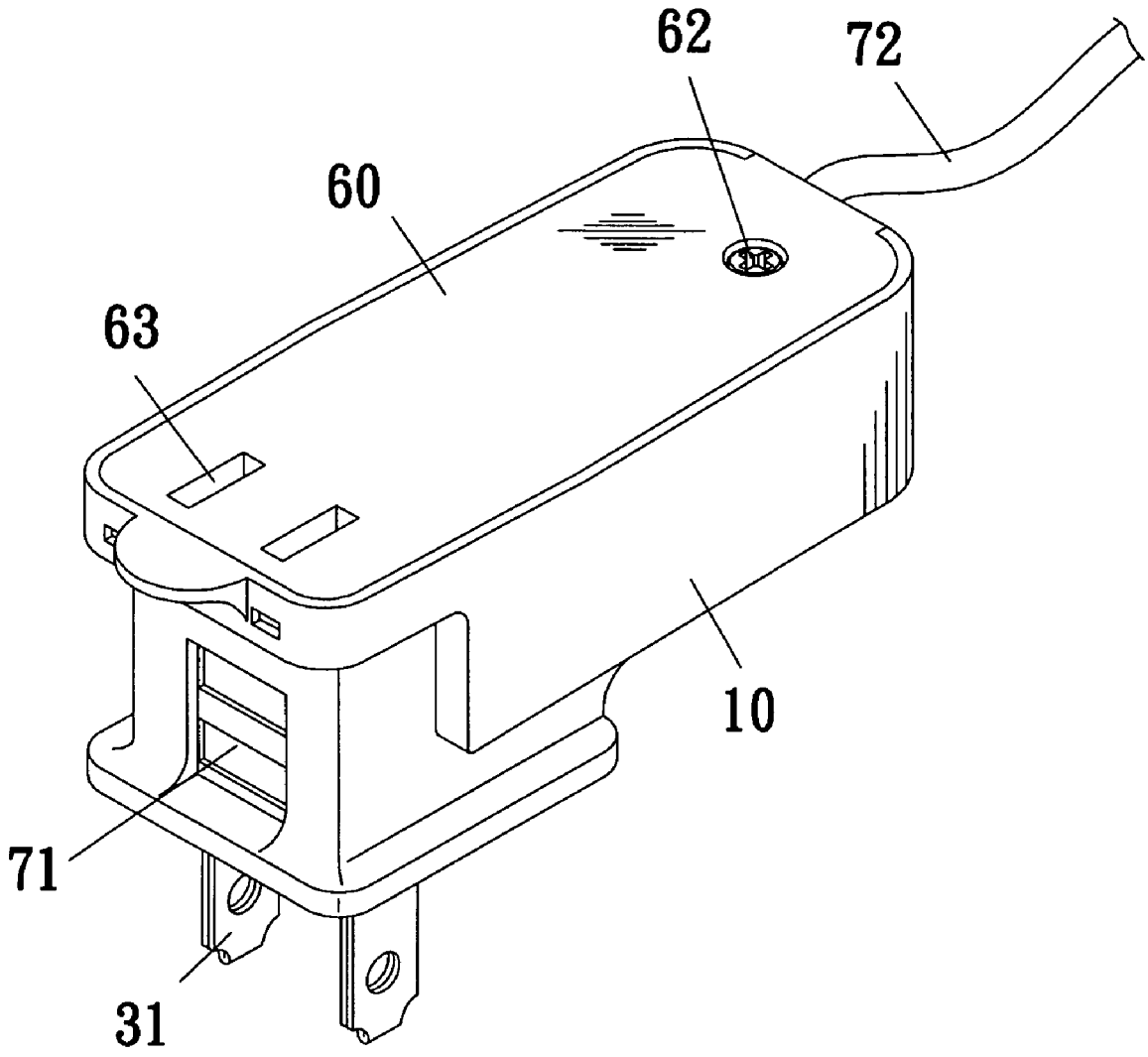
FIG. 1 is a perspective view of a preferred embodiment of socket, plug, and adaptor combination with waterproof arrangement according to the invention.
Figure 2A:
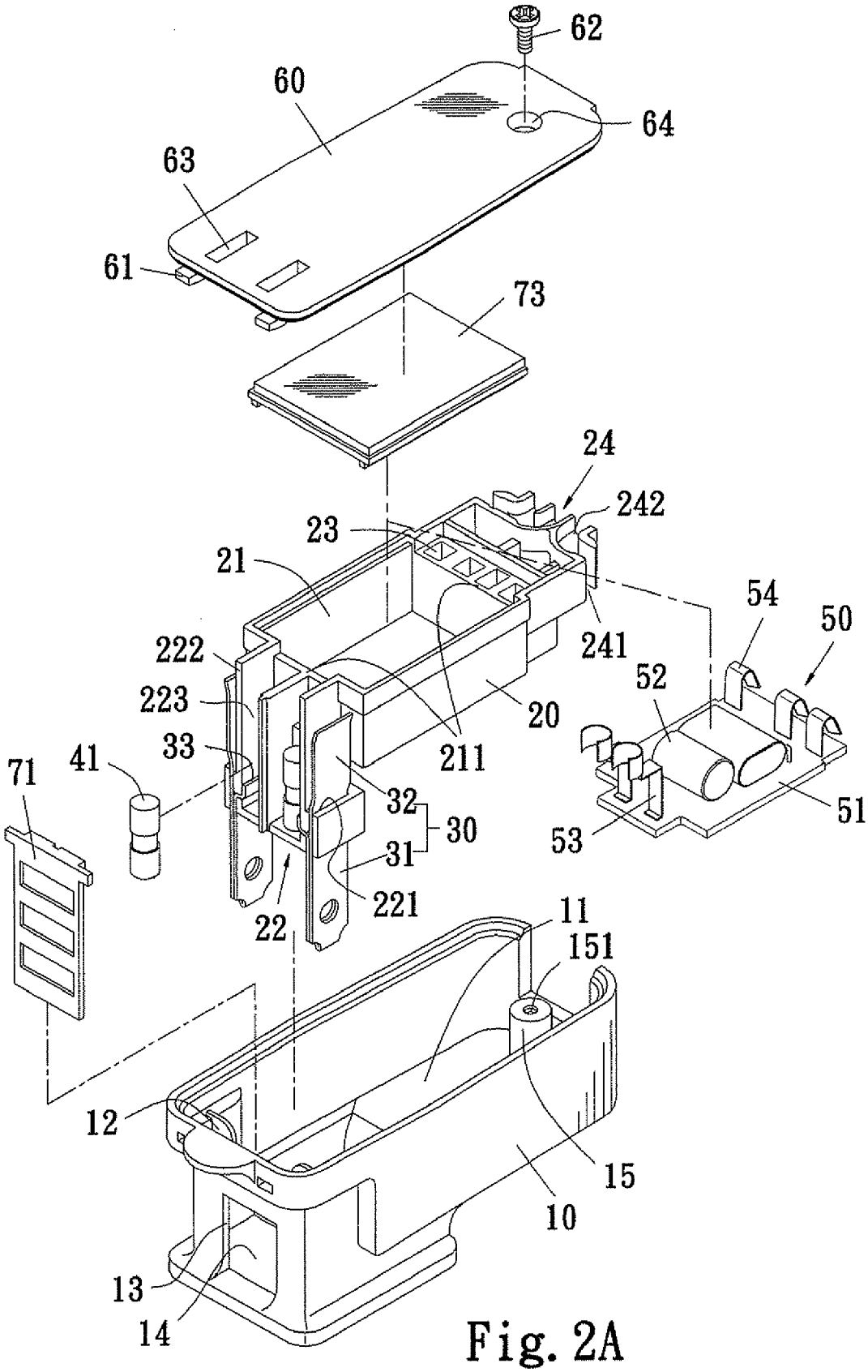
FIG. 2A is an exploded view of the combination of FIG. 1, where a first configuration of transformers is shown.
Figure 2B:
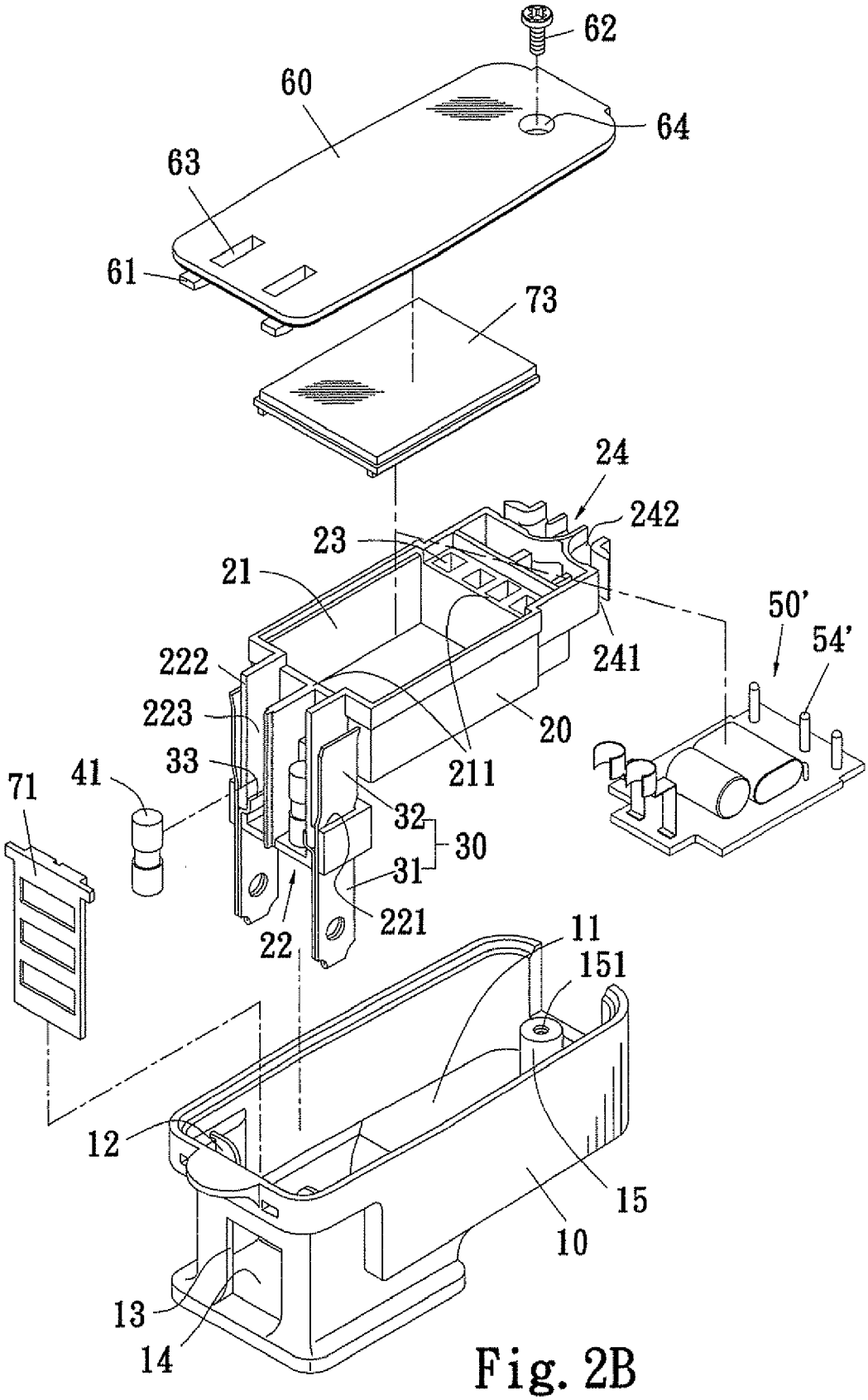
FIG. 2B is an exploded view of the combination of FIG. 1, where a second configuration of transformers is shown.
Figure 3:
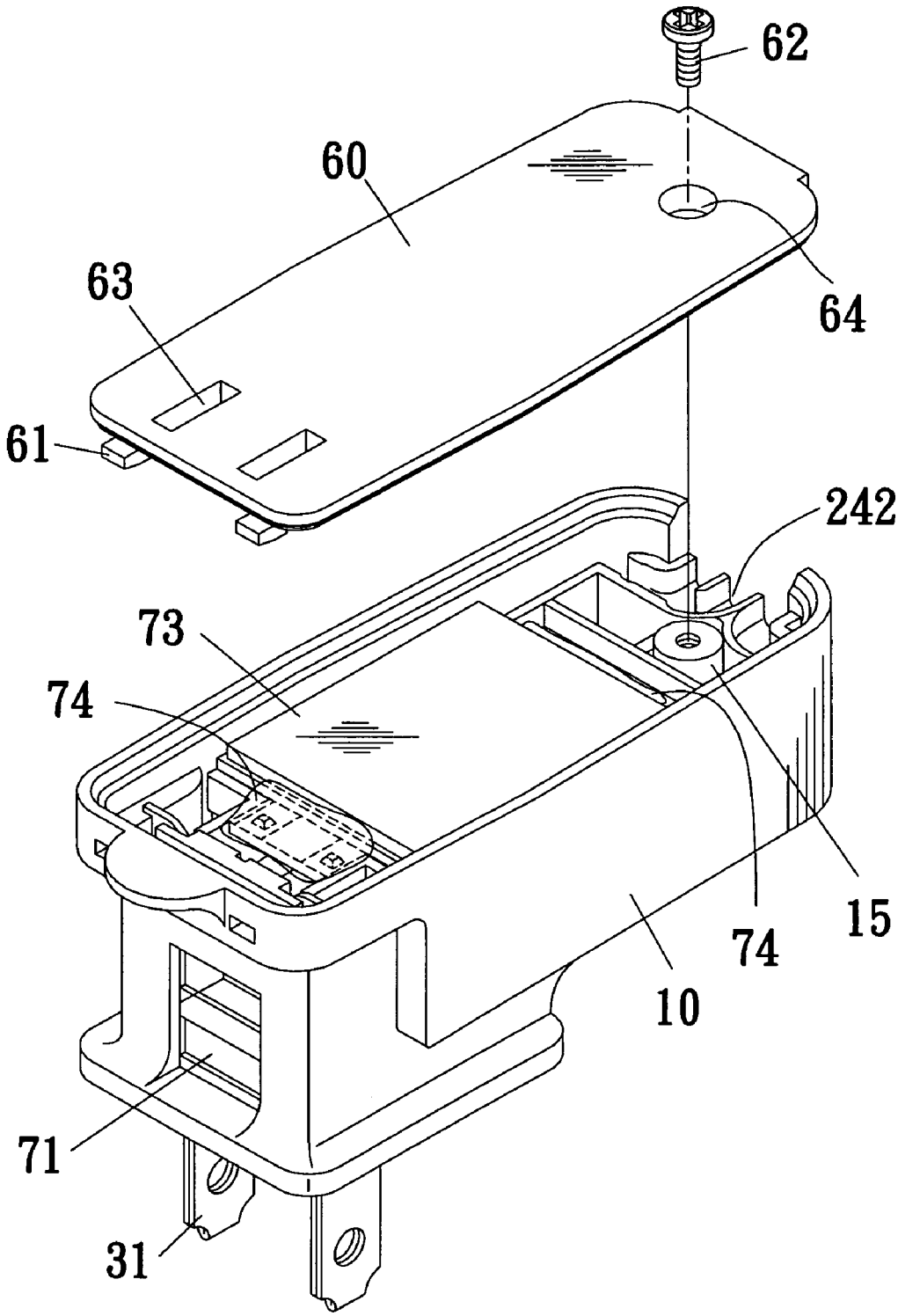
FIG. 3 is similar to FIG. 1 with the cover to be secured thereon.

Referring to FIGS. 1 to 5, a socket, plug, and adaptor combination in accordance with a preferred embodiment of the invention is shown. The combination is applicable to be used as a charger for outdoor LED (light-emitting diode) type Christmas light strings, outdoor LED type lamps, mobile phones, etc. In the embodiment, the combination is described by applying to be used with an outdoor LED type Christmas light string. The combination comprises a housing 10, a circuit assembly 20, two electrical connection assemblies 30, two fuses 41, a transformer 50, and a cover 60. Each of above components will now be described in detail below.

The housing 10 is a substantially rectangular body and comprises an internal space 11 for receiving the circuit assembly 20, two opposite forward grooves 12 in the space 11, and a front opening 13 between the grooves 12. A sliding door 71 is slidably mounted in the grooves 12 so that the sliding door 71 is adapted to slide upward or downward along the grooves 12 to open or close the opening 13. The housing 10 further comprises a forward bottom opening 14 below the opening 13.

Figure 4:
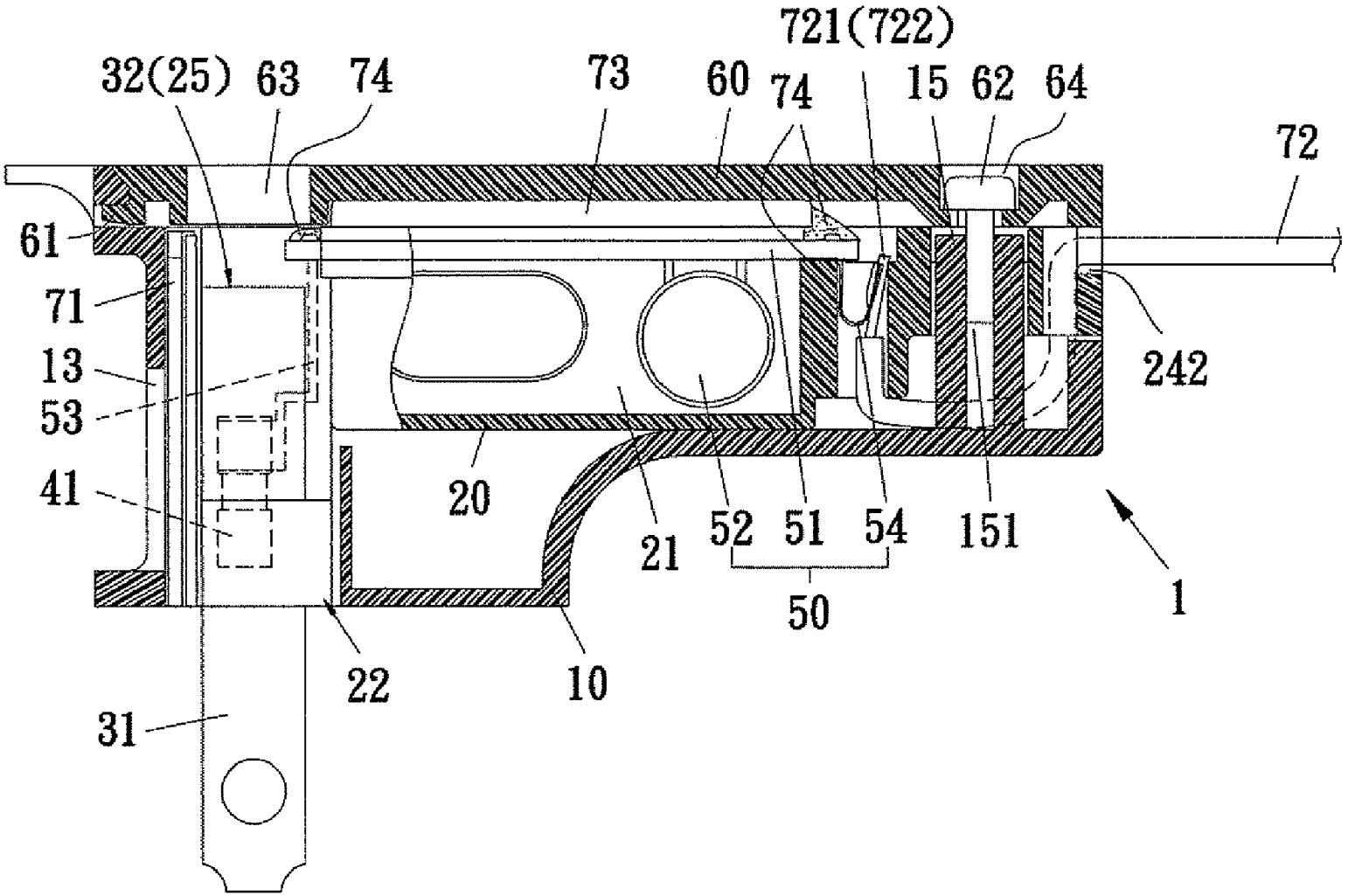
FIG. 4 is a longitudinal sectional view of the combination of FIG. 1 where connection of the first configuration of the transformer and the power cord is shown.
Figure 5:
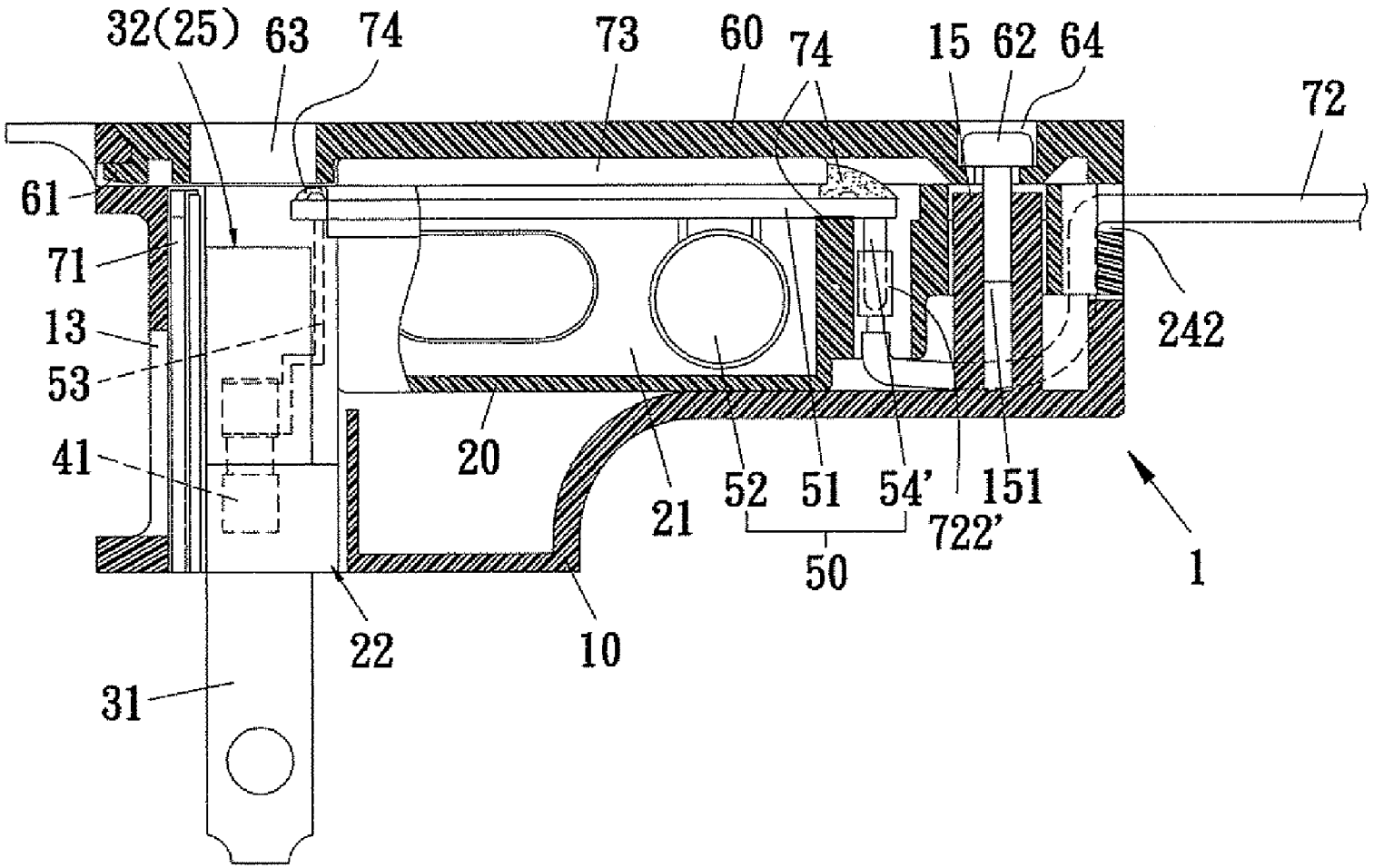
FIG. 5 is a view similar to FIG. 4 where connection of the second configuration of the transformer and the power cord is shown.

The circuit assembly 20 is shaped as an inverted L and comprises an internal space 21 in a horizontal part thereof for mounting the transformer 50 therein, the space 21 having front and rear walls 211 and two side walls (not numbered), a conductor mounting section 22 in a vertical part thereof, the conductor mounting section 22 having two side slots 221, two dividing plates 222 each in either slot 221, and two compartments 223 each formed by the dividing plate 222 in either slot 221, a series of troughs 23 with components of the transformer 50 provided therein, and a rear cord connecting section 24 including at either side a bent passage 241 having a rear opening 242 for mounting one ends 722 of two conductors 721 of a power cord 72 therein (see FIG. 4).

Each electrical connection assembly 30 is mounted in the slot 221 as detailed below. The electrical connection assembly 30 comprises an outer prong section 31 extending through the slot 221, an inner prong section 32 being substantially parallel with the dividing plate 222 to define a slit (not numbered) therebetween, and a bent section 33 in the compartment 223. The outer prong section 31 extends through the bottom opening 14.

Each fuse 41 is provided in the compartment 223 behind the sliding door 71 to be electrically connected to the bent section 33. The transformer 50 comprises a circuit board 51 with a plurality of electrical components 52 mounted thereon, a plurality of front elastic conductors 53 electrically interconnected the fuses 41 and the circuit board 51, and a plurality of rear elastic conductors 54 in the troughs 23. Note that the elastic conductors 54 may be shaped as bent members (i.e., female members) to be electrically interconnected the circuit board 51 and the projecting ends 722 (i.e., male members) of the conductors 721 of the power cord 72 (see FIG. 4 and the transformer 50 of FIG. 2A). Alternatively, the elastic conductors 54' may be shaped as posts (i.e., male members) to be electrically interconnected the circuit board 51 and sleeve ends 722' (i.e., female members) of the conductors 721 of the power cord 72 (see FIG. 5 and the transformer 50' of FIG. 2B).

The transformer 50 is adapted to convert line voltage in the range of AC 100-240 volt into DC 24 volt or a predetermined DC voltage value. The circuit board 51 is flush with the top of the space 21 with a covering plate 73 mounted thereon.

A plurality of waterproof members (e.g., adhesives) 74 are provided on tops of front and rear walls 211, tops of front and rear ends of the circuit board 51, and the front and rear ends of the covering plate 73 by coating so that the transformer 50 can be made waterproof.

The cover 60 is rectangular and comprises two forward tabs 61 adapted to slide into two slots (not numbered) on the upper front portion of the housing 10, two spaced, rectangular sockets 63 adjacent the front end behind the tabs 61, the sockets 63 being vertically aligned with slits 25 with the inner prong sections 32 disposed therein (see FIG. 4), and a fastener (e.g., screw) 62 adapted to drive through a rear through hole (64) into a threaded hole 151 of a post 15 in the space 11 of the housing 10 for securing the cover 60 onto the circuit assembly 20 which is disposed in the space 11 of the housing 10.

Figure 6:
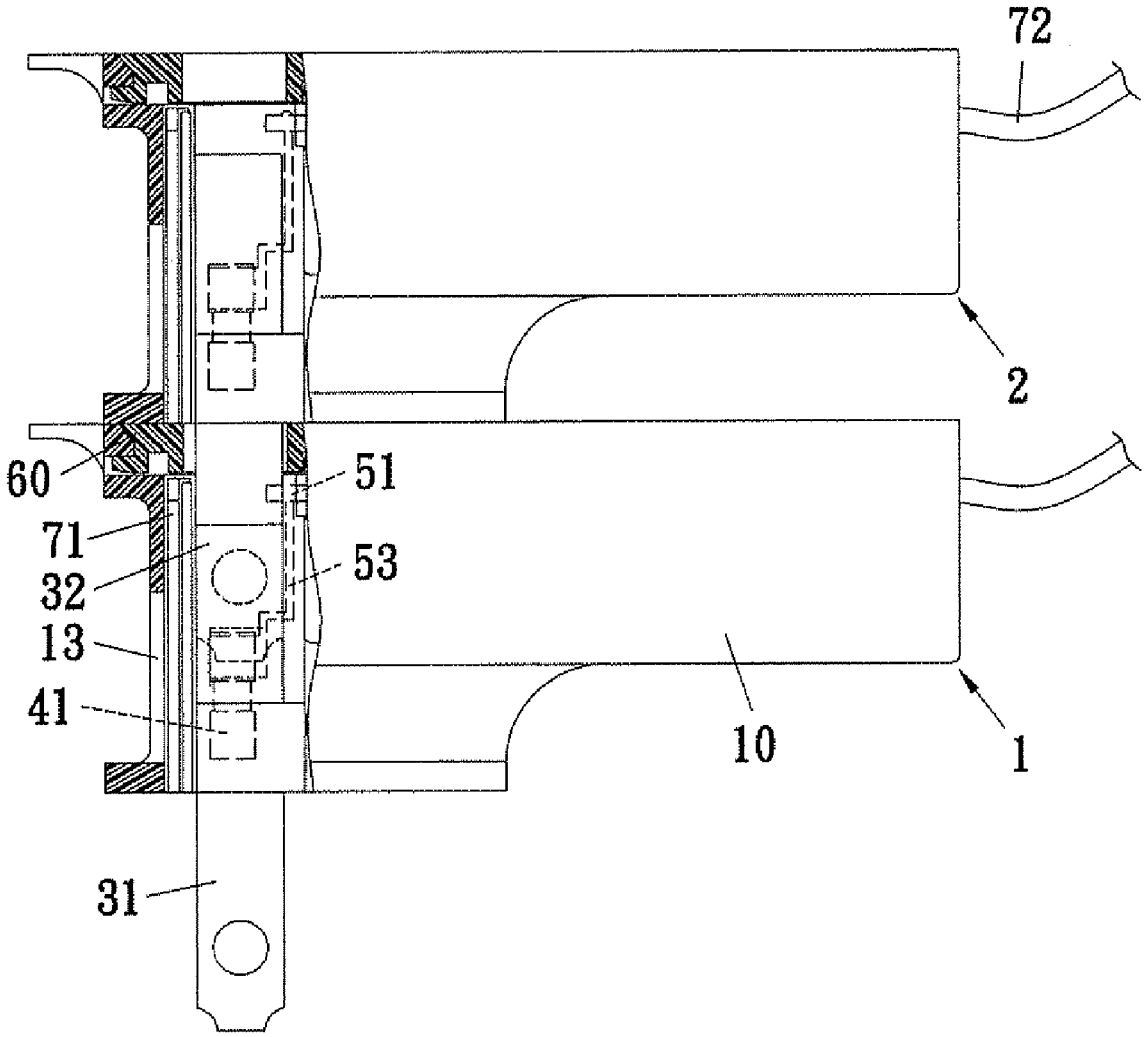
FIG. 6 is a fragmentary longitudinal sectional view schematically showing two combinations being connected together.

Referring to FIG. 6, an exemplary implementation of the invention is illustrated. As shown, a second combination 2 may have its inner prong sections inserted through the sockets of a first combination 1 of the same type into the slits of the first combination 1 to be electrically connected to the inner prong sections 32 of the first combination 1. As a result, the first and second combinations 2 are electrically connected together.

Figure 7:
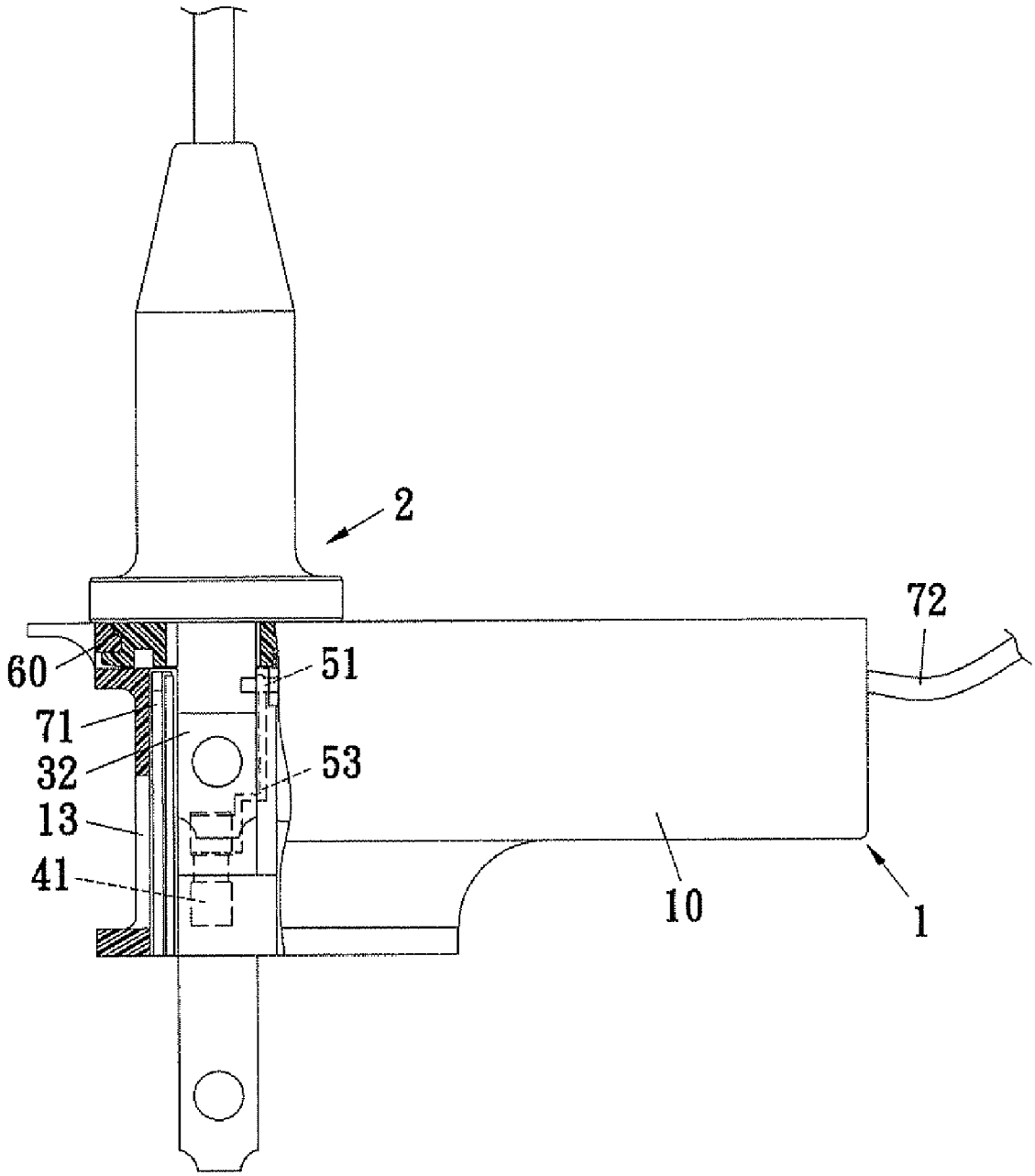
FIG. 7 is a fragmentary longitudinal sectional view schematically showing the combination and a typical plug being connected together.

Referring to FIG. 7, another exemplary implementation of the invention is illustrated. As shown, a typical plug 2 of an electrical device may have its prongs (not shown) inserted through the sockets 63 of a combination 1 of the invention into the slits of the combination 1 to be electrically connected to the inner prong sections 32 of the combination 1. As a result, the electrical device and the combination 1 of the invention are electrically connected together. The combination 1 of the invention is adapted to supply rectified voltage (e.g., DC 24 volt) to the electrical device for use or charging because the combination 1 of the invention has the function of charging due to the provision of the transformer 50.

While the invention herein disclosed has been described by means of specific embodiments, numerous modifications and variations could be made thereto by those skilled in the art without departing from the scope and spirit of the invention set forth in the claims.

What is claimed is:

1. A socket, plug, and adaptor combination comprising:

a housing comprising two opposite forward grooves, a sliding door slidably disposed between the grooves, and a bottom opening;

an inverted L-shaped circuit assembly disposed in the housing and comprising a horizontal internal space, a cord connecting section, a vertical conductor mounting section, a first wall separating the horizontal internal space from the vertical conductor mounting section, a second wall separating the horizontal internal space from the cord connecting section, and a plurality of troughs disposed in the second wall;

a transformer disposed in the space of the circuit assembly and adapted to electrically connect to a power cord, the transformer comprising a circuit board, a plurality of electrical components mounted on the circuit board, a plurality of first elastic conductors electrically connected to the circuit board, and a plurality of second elastic conductors in the troughs;

two electrical connection assemblies each disposed in the conductor mounting section and comprising a prong extending through the bottom opening;

a conductive assembly comprising two separate fuses disposed in the conductor mounting section, each fuse being electrically interconnected the prong and the transformer;

a cover releasably secured onto the circuit assembly and comprising two sockets distal the prongs;

a covering plate disposed between the transformer and the cover; and a plurality of waterproof members securely disposed on front and rear ends of a top of the transformer, front and rear ends of the horizontal part of the circuit assembly, and front and rear ends of the covering plate.

2. The socket, plug, and adaptor combination of claim 1, wherein the fuses are disposed behind the sliding door.

3. The socket, plug, and adaptor combination of claim 1, wherein the sockets and the prongs are aligned.

* * * * *